US005853318A

United States Patent [19]

Thom et al.

[11] Patent Number: 5,853,318

[45] Date of Patent: Dec. 29, 1998

[54] ROLL SURFACE GRINDER

[75] Inventors: Kelsey C. Thom, Litchfield, N.H.; Heath L. Hartwig, Waterloo, Iowa

[73] Assignee: Consolidated Process Machinery, Inc., Merrimack, N.H.

[21] Appl. No.: 962,276

[22] Filed: Oct. 31, 1997

Related U.S. Application Data

[60] Provisional application No. 60/029,692, Oct. 31, 1996.

[51] Int. Cl.[6] ..... B24B 19/18

[52] U.S. Cl. ..... 451/425; 451/424; 451/426; 451/319; 451/419; 451/49; 451/258

[58] Field of Search ..... 451/425, 49, 258, 451/424, 426, 419, 319

[56] References Cited

U.S. PATENT DOCUMENTS

| | | | |
|---|---|---|---|
| 1,429,316 | 9/1922 | Bagi | 451/444 |
| 1,968,550 | 7/1934 | Barnes . | |
| 2,016,590 | 10/1935 | Bussing . | |
| 2,140,860 | 12/1938 | Steele | 451/425 |
| 2,671,296 | 3/1954 | Geyer . | |
| 2,674,835 | 4/1954 | Senft . | |
| 2,830,634 | 4/1958 | Pollmann . | |
| 3,165,865 | 1/1965 | Bousquet et al. | 451/424 |
| 3,430,400 | 3/1969 | Parrella et al. . | |
| 3,466,808 | 9/1969 | Mess | 451/425 |
| 3,585,881 | 6/1971 | Sarka | 451/425 |
| 3,660,947 | 5/1972 | Clark, Jr. . | |
| 4,746,074 | 5/1988 | Wistuba et al. . | |
| 5,618,224 | 4/1997 | Dumas | 451/425 |

OTHER PUBLICATIONS

"The World is Moving in our Direction, The Amacoil/Uhing Linear Drive System" brochure, Amacoil, Inc.

*Primary Examiner*—Robert A. Rose
*Assistant Examiner*—George Nguyen
*Attorney, Agent, or Firm*—Nixon & Vanderhye

[57] ABSTRACT

A roll surface grinder includes a frame mounted on a carriage assembly for traversing movement between opposite sides of the frame in a direction parallel to the axis of the roll subject to grinding. The carriage assembly includes a linear drive system for controlling the transverse back-and-forth motion and speed of the carriage assembly along the frame during grinding. The carriage assembly includes a swing arm pivotally mounted on the frame and pivotal relative to the carriage assembly. The pivot angle of the swing arm relative to the carriage assembly can be adjusted manually to adjust the depth of the grinding.

6 Claims, 5 Drawing Sheets

ROLL SURFACE GRINDER

RELATED APPLICATIONS

This application is a continuation of provisional application Ser. No. 60/029,692, filed Oct. 31, 1996.

TECHNICAL FIELD

The present invention relates to a surface roll grinder for shaping and contouring the surfaces of a pair of rolls in a particle processing machine and particularly relates to a roll surface grinder for grinding the surfaces of rolls of a flaking mill.

BACKGROUND

In a particle processing machine, such as a flaking mill, a pair of generally large-diameter rolls formed, for example, of chilled cast iron, are journalled in a machine frame, creating a nip forming a predetermined gap between the rolls and through which particulate material being processed passes. Ideally, a constant gap between the rolls and over the entirety of their lengths should be maintained. Practically, however, the gap often varies over time due to a variety of factors. For example, uneven or surging of the feed material into the nip of the rolls produces alternating cycles of instantaneous high feed and starved rolls. High feed rates produce undesirable roll separating forces and high loads on the roll bearings. Low feed rates can result in metal-to-metal running of the rolls with spalling and pitting as a result. Roll wear will typically be greater in the center of the roll, leaving the roll ends high. Hot spots can also form along various areas of the roll, particularly along the roll ends, causing a thermal reaction which can alter the gap, change the roll surface profiles and engage the roll ends against one another. Over time, the constancy of the gap between the rolls changes, with typically a concave roll surface profile being formed. This degrades the constancy of the particles being processed as between middle and end portions of the rolls. Thus, the rolls require periodic grinding to return them to the desired surface profiles.

In typical roll grinding operations, the roll is manually ground by an operator while the processing machine, e.g., a flaking machine, is running. This requires a very skilled operator and considerable machine downtime. There is also the inherent danger of an injury to the operator when grinding large-size rolls rotating in a direction toward a nip. In some cases, a simple fixture or bracket is used to support and guide a hand-operated grinder to facilitate grinding the roll ends. An alternative has been to dismantle the rolls and transport them to specialty shops for grinding. This, of course, incurs substantial expense and downtime. While there are commercially available roll grinding attachments that mount to a flaking mill, such attachments have been cumbersome, and difficult to set up and operate.

DESCRIPTION OF THE PRESENT INVENTION

According to the present invention, there is provided a roll surface grinder which can be readily and easily attached to a particle processing machine, e.g., a flaking mill, in a manner enabling traversing movement of grinding wheels between opposite ends of the roll to accurately grind the roll to the desired roll surface profile. Particularly, the present invention comprises a frame having a pair of laterally spaced end frames joined one to the other by a pair of longitudinally spaced transversely extending structural members, preferably shafts, affording structural rigidity to the frame. The end frames have mounting studs for securing the frame to the processing machine frame in overlying relation to the roll whose surface is to be ground. With proper adjustment of the mounting screws and associated locking nuts, as well as push bolts on the frame, the frame can be adjusted in both horizontal and vertical directions such that the axes of the grinding wheels carried by the frame are precisely parallel to the axis of the roll.

A carriage assembly is mounted on the frame for traversing movement between opposite ends of the roll. Particularly, the carriage assembly is supported at one end by linear bearings mounted along one of the frame shafts. The opposite end of the carriage assembly is supported by a third rotating shaft extending between the end frames. A linear drive system is mounted on the rotating shaft and causes the carriage assembly to traverse the frame. The linear drive system includes a plurality of ballbearing-based rolling rings inside a drive housing. By adjusting the pitch of the rolling rings relative to the axis of the rotating shaft, the housing and hence the carriage assembly can be driven in opposite directions and at variable speeds. A linear drive system per se of this type is known and may comprise the linear drive system manufactured by Amacoil/Uhing, Aston, Pa.

The carriage assembly includes a carriage or swing arm which is also mounted on the forward shaft in linear bearings for traversing movement with the carriage assembly. The swing arm is also pivotable about the forward support shaft by an adjusting mechanism in order to adjust the depth of the grinding wheel carried by the swing arm vis-a-vis the roll surface. To effect the adjustment, the swing arm is also supported along a backside thereof by a screwthreaded block pivotally mounted to the carriage assembly. A threaded manually adjustable rod extends through the screwthreaded block and carries a bearing at its distal end to support the swing arm in adjusted angular positions about the forward support shaft. Thus, by rotating the adjusting rod, the swing arm can be pivoted about the forward support shaft to displace the grinding wheels toward or away from the roll.

The present invention also mounts a pair of grinding wheels on the swing arm rather than just one grinding wheel. By using a pair of grinding wheels at the lateral extremities of the carriage assembly, the full length of the roll can be ground without the carriage assembly extending beyond the roll end. Thus, upon full traverse to one end of the roll, the grinding wheel on that side of the swing arm can grind to the end of the roll. When the carriage assembly traverses to the opposite roll end, the grinding wheel on the opposite side of the swing arm may grind to the opposite end of the roll. Thus, the machine frame need not be extended transversely to accommodate grinding the roll lip to and including its opposite ends.

In a preferred embodiment according to the present invention, there is provided apparatus for grinding a roll of a flaking mill, the roll having a longitudinal axis of rotation, comprising a grinding wheel carriage assembly including a swing arm carrying at least one grinding wheel, support structure for carrying the carriage assembly and mountable on the flaking mill for engaging the grinding wheel against the roll, the structure including a pair of longitudinally spaced structural members extending generally parallel to the axis of rotation of the roll, a shaft carried by the support structure and extending generally parallel to the pair of structural members, a motor for rotating the shaft, the carriage assembly being mounted on the shaft and one of the structural members for traversing movement along the shaft and one member between opposite ends of the roll, a rolling ring drive coupled to the rotating shaft for driving the carriage assembly along the shaft and the one member between opposite ends of the roll and an adjusting mechanism for pivoting the swing arm relative to the carriage assembly to adjust the depth of grinding.

Accordingly, it is a primary object of the present invention to provide a novel and improved roll surface grinder for grinding rolls of a particle processing machine, for example, a flaking mill, which eliminates safety hazards associated with manual grinding of the rolls, reduces costs and machine downtime and is relatively simple to set up and use.

BEST MODE FOR CARRYING OUT THE INVENTION

Figure 1:
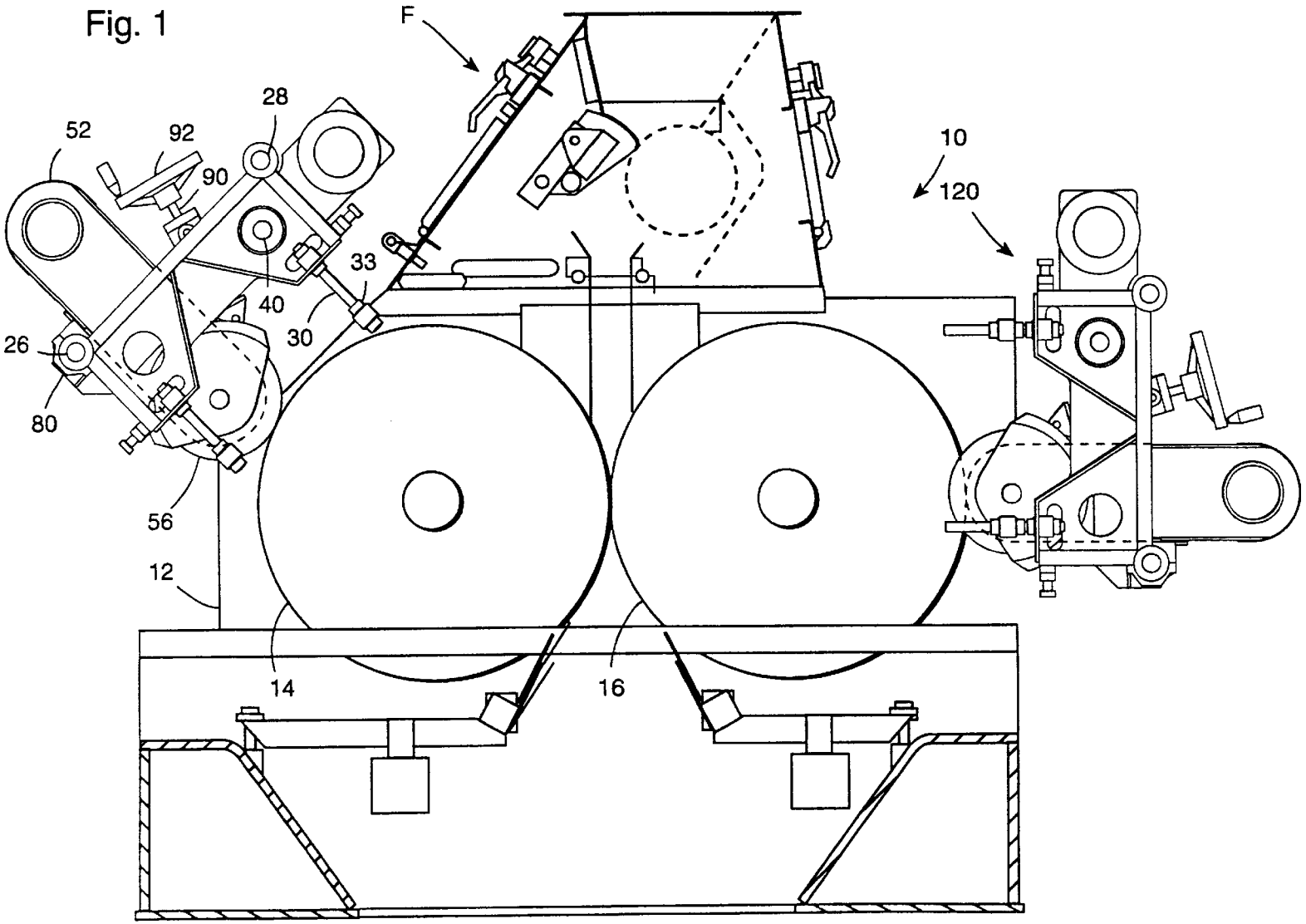
FIG. 1 is a side elevational view of a particulate processing machine, for example, a flaking mill, illustrating two roll surface grinders according to the present invention mounted on the frame of the machine in grinding position.
Figure 1A:
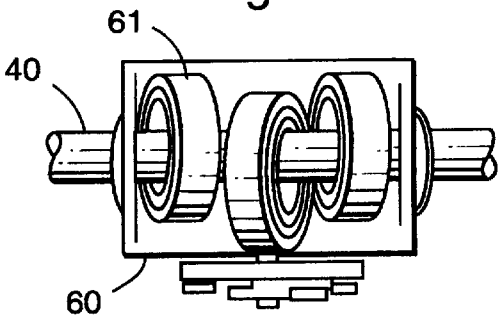
FIG. 1A is a schematic illustration of a linear driving system for the carriage assembly of the grinder hereof.

Referring now to FIG. 1, there is schematically illustrated a particle processing machine, for example, a flaking mill, generally designated 10. The machine 10 includes a machine frame 12 mounting a pair of rolls 14 and 16 defining a nip defining a gap between the rolls. In using the machine, particulate material, for example, particles of soybeans are fed through a feeder, generally designated F, adjacent the top of the machine whereby material is fed into the nip of the rolls between end cheek plates and processed, for example, into flakes having large surface areas to facilitate extraction of soybean oil from the soybeans. The flakes emerge from between the rolls for discharge from the machine in a conventional manner. As indicated previously, the roll surfaces can become worn and require refinishing due to a number of factors, including unequal wear rates. To avoid the problems associated with conventional grinders, e.g., unstable grinding, grinders being too heavy and too bulky to handle, set-up difficulties and complications, and which require highly skilled operators, resulting in high costs, the present invention provides a roll surface grinder, generally designated 20, for performing the grinding operation on the roll surfaces.

Figure 2:
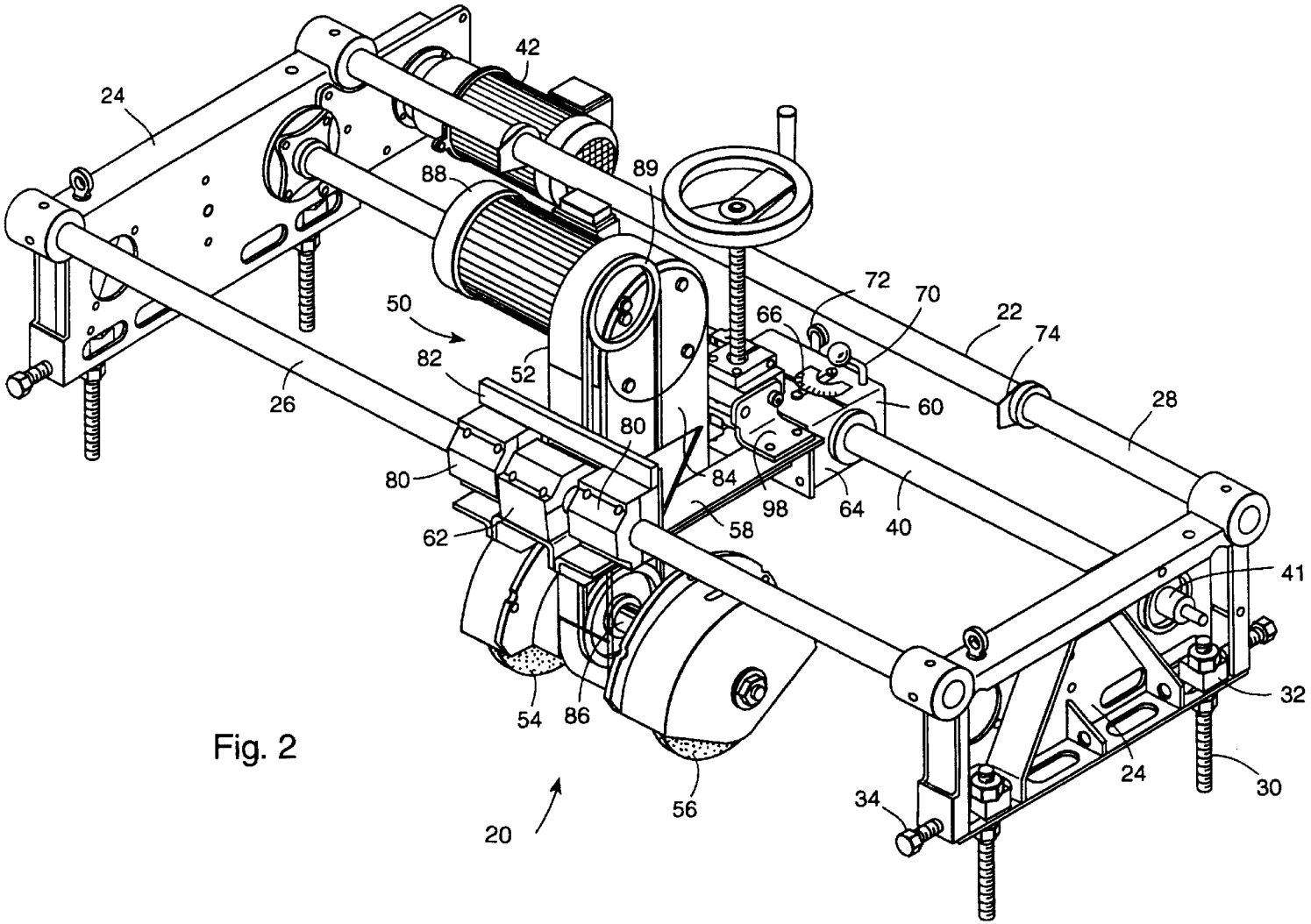
FIG. 2 is a perspective view of the roll surface grinder hereof separate and apart from the particulate processing machine to which it may be attached.

Referring to FIGS. 1 and 2, the roll surface grinder 20 comprises a frame 22 having end frames or end plates 24 secured to one another in spaced lateral relation by a pair of rigid structural members, preferably shafts 26 and 28. The end frames 24 carry depending threaded studs 30 in horizontal slide blocks 32 and which studs 30 are receivable in mounting blocks mounted on the machine frame 12. By providing nuts 33 on opposite sides of the mounting blocks and threaded on the studs 30, it will be appreciated that the frame 22 can be mounted on the machine frame 12 in an adjusted position relative to a vertical or Y direction. Additionally, the frame is adjustable in a horizontal direction under control of push bolts 34 such that the frame 22 can be horizontally adjusted relative to the machine frame 12. Thus, adjustments can be effected in both X and Y directions when the frame 22 is mounted to the machine frame 12.

A third shaft 40 extends between the end plates 24 in suitable bearings 41. A motor, preferably an electric motor 42, rotates the shaft 40 at a constant speed through a belt-and-pulley arrangement housed in one of the end plates 24. As illustrated, the rotating shaft 40 is disposed in the end plates at an elevation slightly below the elevation of shafts 26 and 28 and lies parallel thereto.

A carriage assembly, generally designated 50, is carried by frame 22 for traversing movement between opposite ends of the rolls and frame 22. Carriage 50 includes a swing arm 52 carrying adjacent its lower end a pair of grinding wheels 54 and 56. The carriage assembly 50 is mounted for traversing movement between opposite ends of the frame 20 on the shaft 26 and the rotating shaft 40. The carriage assembly 50 includes a carriage assembly frame 58 which extends between a linear drive system 60 and a linear bearing 62 mounted on forward shaft 26. The linear drive system 60 may be of the type manufactured and sold by Amacoil/Uhing, Aston, Pa. Basically, the system includes a plurality of ballbearing-based rolling rings 61 disposed within the housing 64 and which have surfaces in contact with the rotating shaft 40. The interior surfaces of the rings 61 are in continuous contact with the rotating shaft. By adjusting a lever 66 carried by housing 64, the pitch or angles of the rings relative to one another and the rotating shaft 40 may be changed, thus enabling the system 60 for lateral displacement in opposite directions and at varying speeds depending upon the pitch angle of the rings 61. A control lever 70 is provided on housing 64 for disengaging the drive system from the shaft 40. Additionally, a cam lever 72 is provided on the system 60 for automatically reversing the direction of travel of the carriage assembly 50 upon reaching the ends of the roll. The cam lever 72 may engage against cam surfaces 74 mounted in adjusted positions along the second or rearward frame shaft 28. Consequently, it will be appreciated that the carriage assembly 50 may be driven laterally between opposite roll ends and carries with it the grinding wheels 54, 56 for engaging the surface of roll 14.

In order to provide adjustment of the grinding wheels 54 and 56 relative to the roll, i.e., adjust the grinding depth, the carriage or swing arm 52 is mounted for pivotal adjusting movement relative to the carriage assembly 50. To accomplish this, a pair of linear bearings 80 are mounted for pivotal and sliding movement relative to shaft 26. The bearings 80 are not connected to the carriage assembly frame 58. Rather, bearings 80 are connected to a swing arm support 82. A swing arm housing 84 is secured to support 82. The lower end of the housing 84 carries a grinding wheel shaft 86 in suitable bearings in housing 84. As illustrated in FIG. 2, the upper end of the housing 52 carries a motor 88 which drives the shaft 86 through a suitable belt-and-pulley arrangement 89 within housing 52.

The forward end of the swing arm or carriage 50 is thus supported by the bearings 80 on shaft 26. To provide the pivotal adjustment of the swing arm 50, a threaded rod 90 having a hand wheel 92 at one end is threaded through a mounting block 94 pivotally carried by the carriage assembly 20. More particularly, the mounting block 94 is pivoted by a pin 96 extending through a clevis 98 secured to the carriage assembly frame 58. Thus, the rod 90 is pivotal relative to the carriage assembly by pin 96 as the rod 90 is threaded or unthreaded relative to the threaded mounting block 94. The lower end of threaded rod 90 is mounted in a bearing 100 secured to a mounting block 102. Block 102 is secured to a clevis 104 by a pivot pin 106. The clevis 104 is secured to the back lower side of the swing arm 52.

Figure 4:
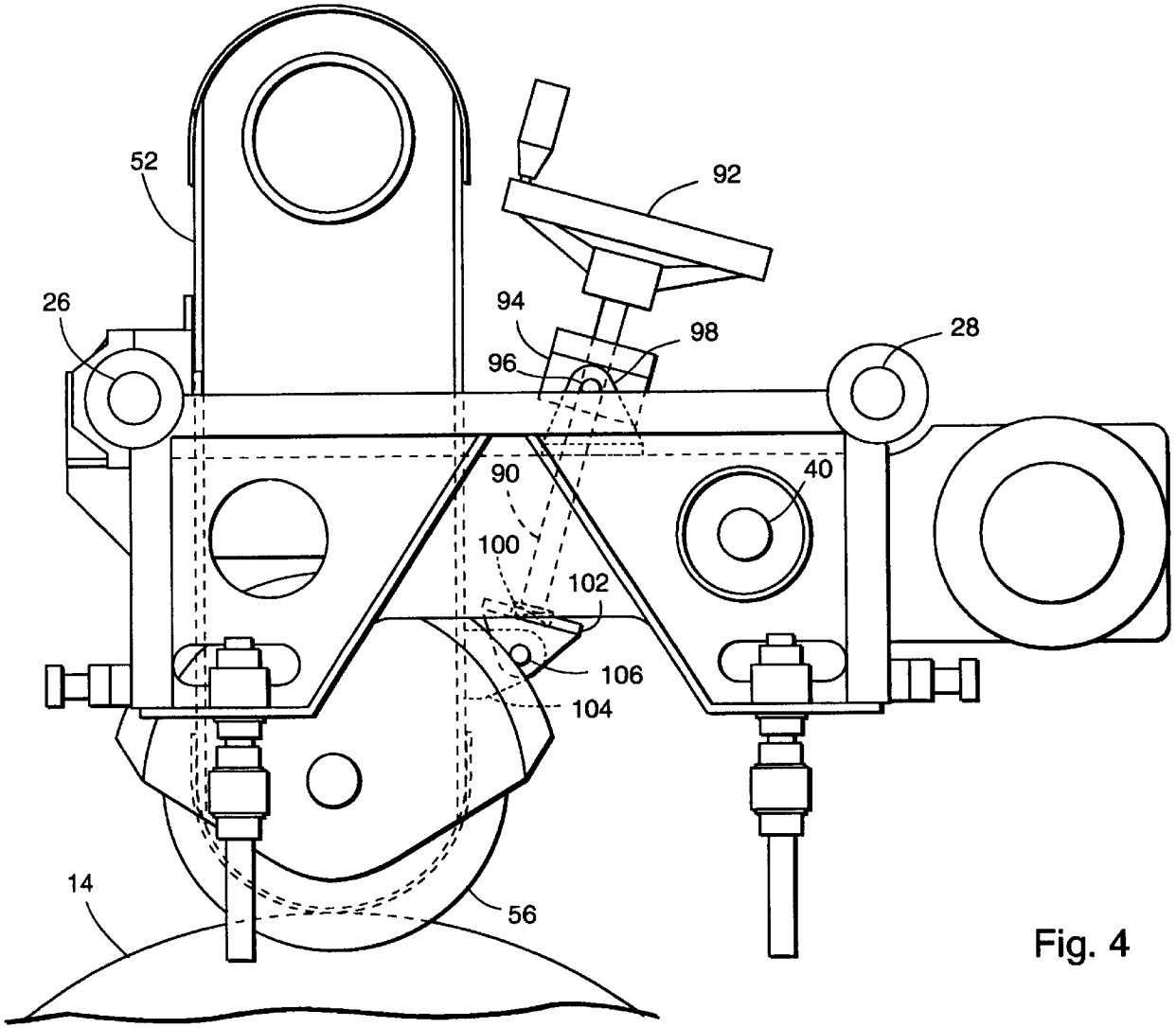
FIG. 4 is an enlarged side elevational view illustrating the roll surface grinder hereof in relation to a roll being ground.
Figure 5:
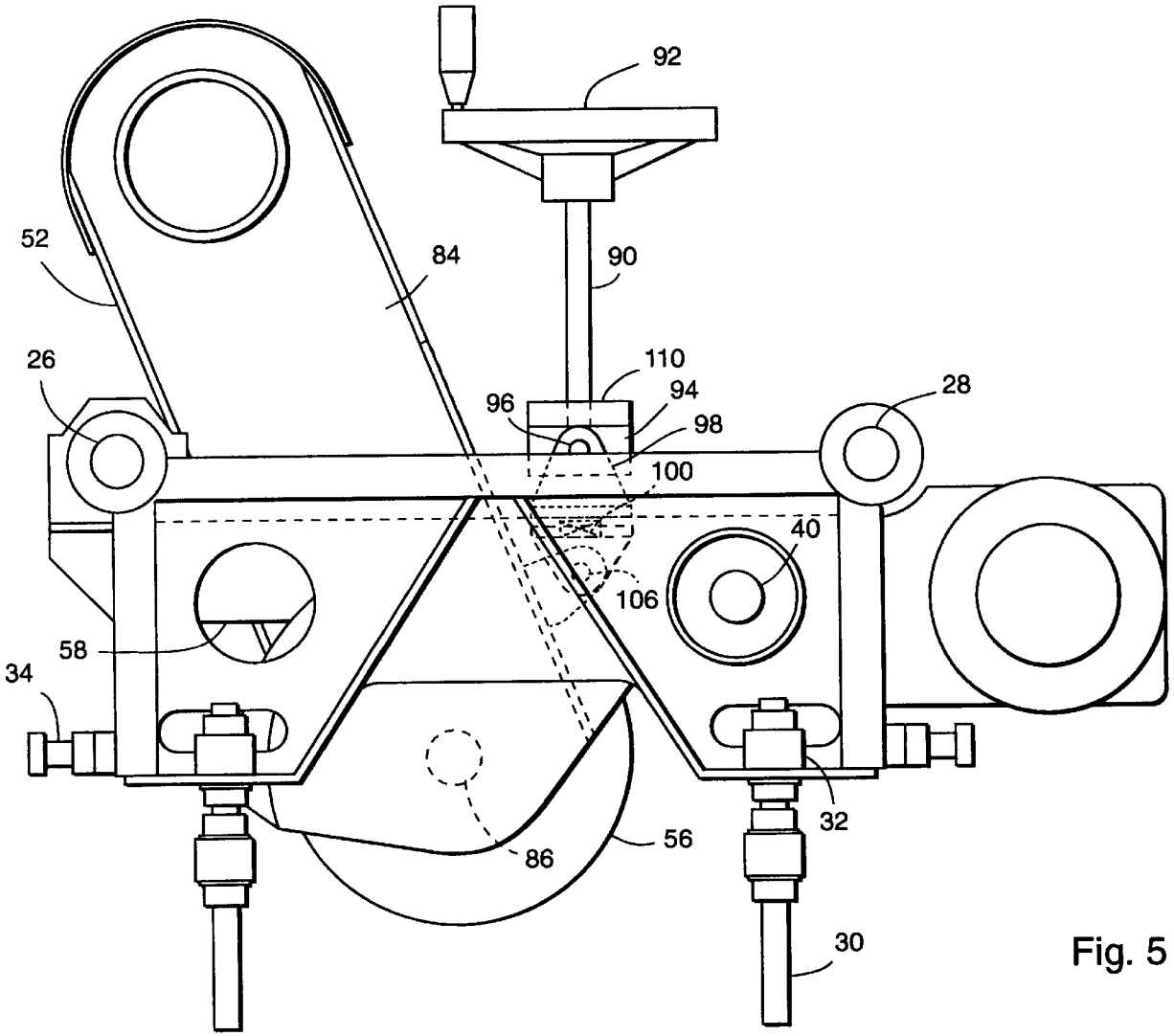
FIG. 5 is a view similar to FIG. 4 illustrating the swing arm of the roll surface grinder in an adjusted position relative to the roll and its position illustrated in FIG. 4.

To adjust the depth of the grinding wheel relative to the roll, the hand wheel 92 is rotated. The threading of rod 90 relative to the threaded mounting block 94 displaces the lower end of rod 90 downwardly. This, in turn, causes rotation of the swing arm 52 about the axis of bearing 80, i.e., the axis of shaft 26, with following rotation of the mounting block 94 relative to the carriage assembly 50. Conversely, unthreading rod 90, as illustrated in FIG. 4, relative to the mounting block 94 elevates the lower end of the rod, pivoting the carriage assembly 50 from the position illustrated in FIG. 4 to the position illustrated in FIG. 5, with concomitant following pivoting action of the mounting block 94. A suitable friction brake 110 is mounted above the mounting block 94 to lock the handle in an adjusted position.

To use the roll surface grinder of the present invention, the grinder frame 20 is disposed on the front or rear of the machine frame 12 (see FIG. 1) and the studs 30 are disposed in the mounting blocks. By adjusting the nuts on opposite sides of the machine frame mounting blocks, the frame can be accurately positioned vis-a-vis the rolls such that the axis of rotation of the grinding wheels 54 and 56 is accurately parallel to the axis of rotation of the rolls. Adjustment of the frame relative to the rolls can also be achieved by adjusting the push bolts 34 which cause displacement of the frame relative to the machine frame in a direction 90° relative to the adjustment afforded by studs 30. By generator motor 88 and adjusting the grinding wheels 54 and 56 relative to the rolls by rotation of the hand wheel 92, the depth of grinding can be set. Actuation of motor 42 then causes shaft 40 to rotate. The pitch may be adjusted on the linear drive system to enable the carriage assembly to initially traverse in one direction or the other as desired and also at a selected speed.

Figure 3:
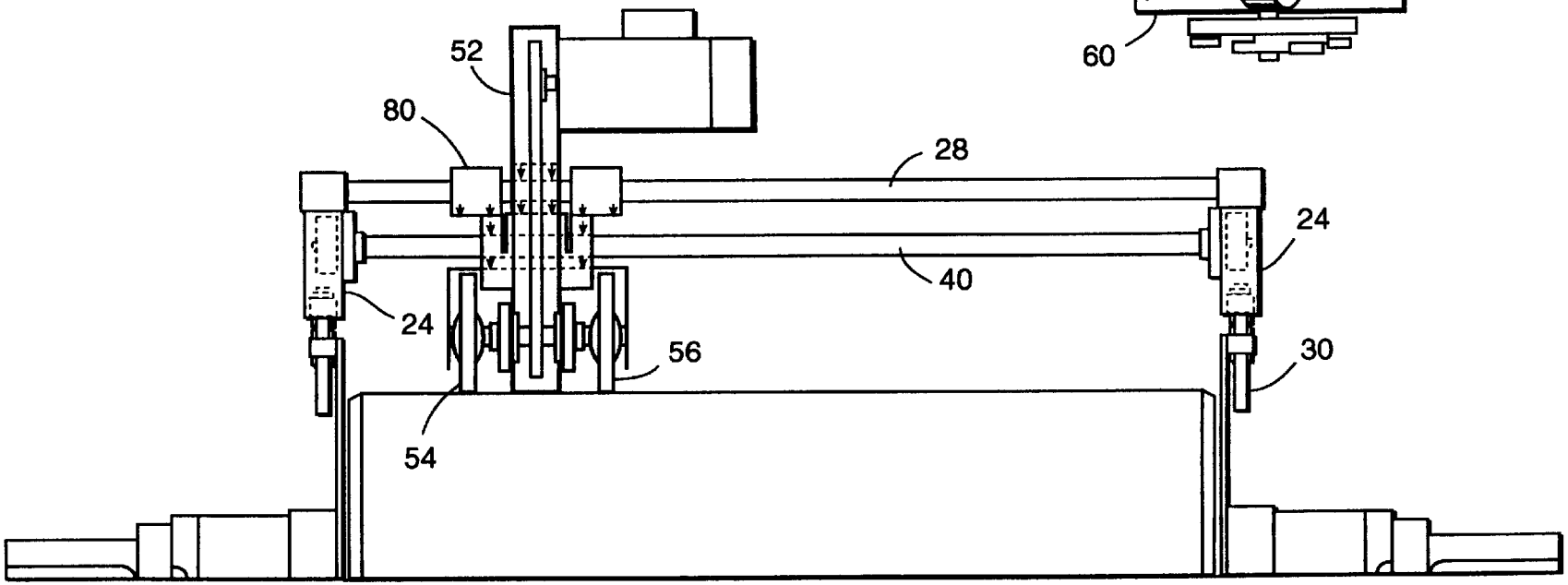
FIG. 3 is a schematic end elevational view of the roll surface grinder in relation to the roll being ground.

When the drive assembly 60 drives the carriage assembly to one end of the frame 20, the cam lever 72 engages the cam surface 74 to change the pitch of the rings of the linear drive system 60 whereby the direction of traverse of the carriage assembly along the frame is reversed. It will be appreciated from a review of FIG. 3 that the grinding wheels 54 and 56 lie at the outer lateral extremities of the carriage assembly. Consequently, when the carriage assembly approaches one of the roll ends, the grinding wheel adjacent that roll end can grind up to and including the end of the roll. Conversely, the grinding wheel at the opposite side of the carriage assembly may grind up to and including the end of the roll at the opposite end of the roll when the carriage assembly traverses to the opposite side of the machine. Furthermore, it is possible to provide a taper in the roll ends by adjustment of the mounting of the frame to the machine. For example, if it is desired to provide a taper in the right side of the roll as illustrated in FIG. 3, the frame on that side can be lowered by rotating the nuts on that side of the machine frame. Thus, the carriage assembly will traverse downwardly at a slight angle toward that end of the roll to provide a taper at the roll end. A similar taper may be provided at the opposite end by adjusting the nuts and studs at the opposite end of the frame. It will be appreciated that the frame, after grinding one of the rolls of the machine 10 can be remounted on the machine frame to overlie and grind the other roll. Alternatively, a pair of roll surface grinders may be secured to the machine frame overlying the respective rolls to simultaneously grind the rolls as illustrated in FIG. 1, the second roll surface grinder being designated 120.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. Apparatus for grinding a roll of a flaking mill, the roll having a longitudinal axis of rotation, comprising:

a grinding wheel carriage assembly including a swing arm carrying at least one grinding wheel;

support structure for carrying said carriage assembly and mountable on the flaking mill for engaging said grinding wheel against the roll, said structure including a pair of longitudinally spaced structural members extending generally parallel to the axis of rotation of the roll;

a shaft carried by said support structure and extending generally parallel to said pair of structural members;

a motor for rotating said shaft;

said carriage assembly being mounted on said shaft and one of said structural members for traversing movement along said shaft and one member between opposite ends of the roll;

a rolling ring drive coupled to said rotating shaft for driving said carriage assembly along said shaft and said one member between opposite ends of the roll; and an adjusting mechanism for pivoting said swing arm relative to said carriage assembly to adjust the depth of grinding;

said swing arm being mounted for adjustable pivotal movement about said one member.

2. Apparatus according to claim 1 wherein said one member comprises a structural shaft, said carriage assembly comprising linear bearings for traversing movement along said one structural shaft, said swing arm being mounted in linear bearings for traversing movement along said one structural shaft with said carriage assembly.

3. Apparatus according to claim 1 wherein said swing arm is mounted for adjustable pivotal movement about one of said one member, said one member comprising a structural shaft, said carriage assembly comprising linear bearings for traversing movement along said one structural shaft, said swing arm being mounted in linear bearings for traversing movement along said one structural shaft with said carriage assembly.

4. Apparatus for grinding a roll of a flaking mill, the roll having a longitudinal axis of rotation, comprising:

a grinding wheel carriage assembly including a swing arm carrying at least one grinding wheel;

support structure for carrying said carriage assembly and mountable on the flaking mill for engaging said grinding wheel against the roll, said structure including a pair of longitudinally spaced structural members extending generally parallel to the axis of rotation of the roll;

a shaft carried by said support structure and extending generally parallel to said pair of structural members;

a motor for rotating said shaft;

said carriage assembly being mounted on said shaft and one of said structural members for traversing movement along said shaft and one member between opposite ends of the roll;

a rolling ring drive coupled to said rotating shaft for driving said carriage assembly along said shaft and said one member between opposite ends of the roll; and an adjusting mechanism for pivoting said swing arm relative to said carriage assembly to adjust the depth of grinding;

said swing arm including a pair of laterally spaced grinding wheels such that, upon traversing movement in one lateral direction, at least one of said pair of grinder wheels is positionable to grind one end of the roll up to and including the one roll end and, upon traversing movement in an opposite lateral direction, another of said pair of grinding wheels is positionable to grind an opposite end of the roll up to and including said opposite roll end.

5. Apparatus for grinding a roll of a flaking mill, the roll having a longitudinal axis of rotation, comprising:

a grinding wheel carriage assembly including a swing arm carrying at least one grinding wheel;

support structure for carrying said carriage assembly and mountable on the flaking mill for engaging said grinding wheel against the roll, said structure including a pair of longitudinally spaced structural members extending generally parallel to the axis of rotation of the roll;

a shaft carried by said support structure and extending generally parallel to said pair of structural members;

a motor for rotating said shaft;

said carriage assembly being mounted on said shaft and one of said structural members for traversing movement along said shaft and one member between opposite ends of the roll;

a rolling ring drive coupled to said rotating shaft for driving said carriage assembly along said shaft and said one member between opposite ends of the roll; and an adjusting mechanism for pivoting said swing arm relative to said carriage assembly to adjust the depth of grinding;

said adjusting mechanism including a screwthreaded rod threaded to a mounting block pivotally carried by said carriage assembly, said screwthreaded rod being connected to said swing arm whereby threading said screwthreaded rod in said mounting block pivots said swing arm to adjust the grinding wheel relative to the roll.

6. Apparatus for grinding a roll of a flaking mill, the roll having a longitudinal axis of rotation, comprising:

a grinding wheel carriage assembly including a swing arm carrying at least one grinding wheel;

support structure for carrying said carriage assembly and mountable on the flaking mill for engaging said grinding wheel against the roll, said structure including a pair of longitudinally spaced structural members extending generally parallel to the axis of rotation of the roll;

a shaft carried by said support structure and extending generally parallel to said pair of structural members;

a motor for rotating said shaft;

said carriage assembly being mounted on said shaft and one of said structural members for traversing movement along said shaft and one member between opposite ends of the roll;

a rolling ring drive coupled to said rotating shaft for driving said carriage assembly along said shaft and said one member between opposite ends of the roll; and an adjusting mechanism for pivoting said swing arm relative to said carriage assembly to adjust the depth of grinding;

said swing arm including a pair of laterally spaced grinding wheels such that, upon traversing movement in one lateral direction, at least one of said pair of grinder wheels is positionable to grind one end of the roll up to and including the one roll end and, upon traversing movement in an opposite lateral direction, another of said pair of grinding wheels is positionable to grind an opposite end of the roll up to and including said opposite roll end, the adjusting mechanism including a screwthreaded rod threaded to a mounting block pivotally carried by said carriage assembly, said screwthreaded rod being connected to said swing arm whereby threading said screwthreaded rod in said mounting block pivots said swing arm to adjust the grinding wheel relative to the roll.

* * * * *